United States Patent [19]

Boatcallie

[11] Patent Number: 4,861,022

[45] Date of Patent: Aug. 29, 1989

[54] PORTABLE FOREARM EXERCISER

[76] Inventor: Billie Boatcallie, 7047 Bissonet, #51, Houston, Tex. 77074

[21] Appl. No.: 228,481

[22] Filed: Aug. 5, 1988

[51] Int. Cl.[4] ..... A63B 21/02

[52] U.S. Cl. ..... 272/137; 272/67; 272/135; 272/142; 272/143

[58] Field of Search ..... 272/67, 116, 135, 137, 272/139, 140, 141, 142, 143, 901

[56] References Cited

U.S. PATENT DOCUMENTS

| | | | |
|---|---|---|---|
| 3,971,255 | 7/1976 | Varney et al. | 272/116 X |
| 4,022,463 | 5/1977 | Scott, Jr. | 272/142 X |
| 4,268,032 | 5/1981 | Cusi | 272/137 |
| 4,465,276 | 8/1984 | Cox | 272/137 |

FOREIGN PATENT DOCUMENTS

| | | | |
|---|---|---|---|
| 1012574 | 6/1977 | Canada | 272/141 |

*Primary Examiner*—Richard J. Apley
*Assistant Examiner*—Franklin L. Gubernick
*Attorney, Agent, or Firm*—Roy H. Smith, Jr.

[57] ABSTRACT

An exerciser primarily for chest muscles activated by pushing the handle ends of the device toward one another with the forearms, the hands playing an insignificant role in the use of the exerciser. It consists basically of a pair of levers rotatably secured to each other by a pivot pin joining the two levers near one pair of their ends, and elastic bands biasing the device in an open stance attitude, with the levers spread apart. Each elastic band has its pair of ends connected to the pair of levers, one end to the distal portion of a lever and the other end to the proximal or handle portion of the other lever. Forearm activation is provided for by mounting a pair of concave forearm cups near the handle ends of the levers, these cups being mounted adjacent the handle ends on the outside of the levers, with the concavity facing outward in each case. The user grips the exerciser with her forearms (in vertical position) and pushes her forearms together in the manner of closing the jaws of a vise.

4 Claims, 2 Drawing Sheets

PORTABLE FOREARM EXERCISER

The invention disclosed and claimed in the present patent is a portable exerciser, particularly for the pectoral muscles of the chest. Lest the title selected be thought misleading, it is here pointed out that it includes the adjective "forearm" because it is forearm activated. The principal contact of the user's body is her forearms, and the force exerted on the device is exerted by the forearms.

Throughout the following the exerciser of the invention will be described in terms of use by a woman, for instance by use of the feminine pronouns "she" and "her". This is because the inventor is a woman, and because she conceived and developed here invention with the needs of women foremost in her mind. However, the exerciser is not limited to use by women, as men will also profit by its employment. Therefore when the feminine pronoun is used it should be read as including the male pronoun as well.

There is or has been a need for an exerciser of the type disclosed herein, one which is lightweight, portable, and relatively inexpensive. There are exercise machines in gymnasia and exercise salons which achieve the same muscle-using functions, such as the well known "butterfly" machines. However, such machines are large, bulky and heavy, and their expense is so high as to preclude purchase by all but the wealthy. They also require a fixed place of installation, a dedicated place of installation from which they are moved only with a great deal of work and expense.

By contrast, the present exerciser is made chiefly of a lightweight but strong material, aluminum tubing for example, and weighs only a couple of pounds. It takes up only a small amount of space and is thus readily transported. It is so portable that the user at home can use it in any room in her house, and can carry it in her car to her office, to the beach etc. It can be used by any adult member of the family, with simple adjustments made to change the force required for operation for different users (or when the same user wants to increase such force). It can also be made in children's sizes, for instance for use by grade school students. And its inexpensive material and labor requirements implies that it can be sold at a modest price, affordable by all who are interested.

The prior art includes some portable exercisers intended to stress the chest muscles, but all of these that the present inventor is aware of are operated by the hands; the user grips the device in her two hands, in spread-arms attitude, and exerts force through her hands to bring them together no other part of her body touches the device. While such exercisers have their allotted roles, the present inventor has conceived an exerciser which can be used by people who, for one reason or another, do not have strong hands, even including those who have lost some hand tissue and function. The invention exerciser does not require the operating force to be applied through the hands. Instead the needed force is applied to the exerciser through the user's forearms, the hands being somewhat unnecessary to surplus, somewhat like the thumb of the potter in *Zorba the Greek.*

A short and general description of the present invention starts with the fact that it consists basically of a pair of levers pivotally connected to one another adjacent one pair of ends, somewhat in the manner of a pair of scissors, shears or tongs. Probably the best comparison is with a pair of pruning shears, which typically have a fairly short blade portion on one side of the pivot and a long handle portion on the other side. The exerciser of the invention has such short and long portions on both levers, and we consider the two short portions to be the distal ends or portions, while the opposite pair of ends, on the much longer portions of the levers on the other side of the pivot, are the proximal ends (proximal portions), because this pair of ends is addressed by the user and is nearer to her. Near such proximal ends are fixed a pair of forearm cups, mounted so that the concavity of each cup faces outwardly, away from the center of the exerciser. The endmost portion of each proximal end is curved to provide a convenient handgrip lying just above the forearm cup of the same lever - when the exerciser is in its normal horizontal position. This provides a definite place to position the hands, although as indicated above the hands play a minor role. They are used more to bring the exerciser into its most common use position, with both levers and thus the device as a whole lying in a horizontal plane in front of the user, at upper chest elevation. The exerciser can even be used by a person who is unable to use one or both hands, or one or both wrists, although in extreme cases she may require some third party assistance in getting the device into the exercise position.

At the distal end of the exerciser of the invention, a pair of resilient means are provided to serve as a force to be overcome as the scissors-like exerciser is operated. Each resiliient means is a number of heavy elastic bands in the preferred embodiment to be described, although of course other means such as tension springs may be substituted. Each resilient means has its two ends secured to both of the levers, one point of anchorage being on the tip of, say the righthand lever while its other end is fastened to the lefthand lever, but at an attachment point on the proximal side of the pivot pin. These resilient means are mounted to their anchors and pre-tensioned while the exerciser is in open attitude. i.e., with the proximal ends spread apart from one another to the maximum extent. This biases the exerciser to the open position, and force must be applied to stretch the resilient means and force the proximal ends of the levers together. The user provides such force as she first mounts the exerciser between her forearms, each forearm being received on the outside of a lever in the cup there provided, and then moves her forearms toward one another, finally meeting at the vertical midplane of her body. The horizontally held exerciser is also symmetric in such plane, and its handle ends meet in this closed position of the device.

For reasons to be detailed below, the distal end of each lever, lying on the distal side of the pivot point, is curved in a direction back toward the proximal end of the device and toward the proximal side of the opposite lever, but in the same plane. The lefthand lever (left and right referring to the proximal ends gripped by the respective forearms) has its distal end bent to the right, while the righthand lever has its distal end bent back to the left. This optional improvement has to do with how the required operating force varies as the open gap at the proximal end decreases, and requires something of a mathematical explanation.

The invention will doubtless become clearer to the reader by referring to the drawing accompanyng this specification and forming an integral part of the present document. It may also help the reader to read the following detailed description in connection with such examination of the drawing. In the drawing.

Figure 1:
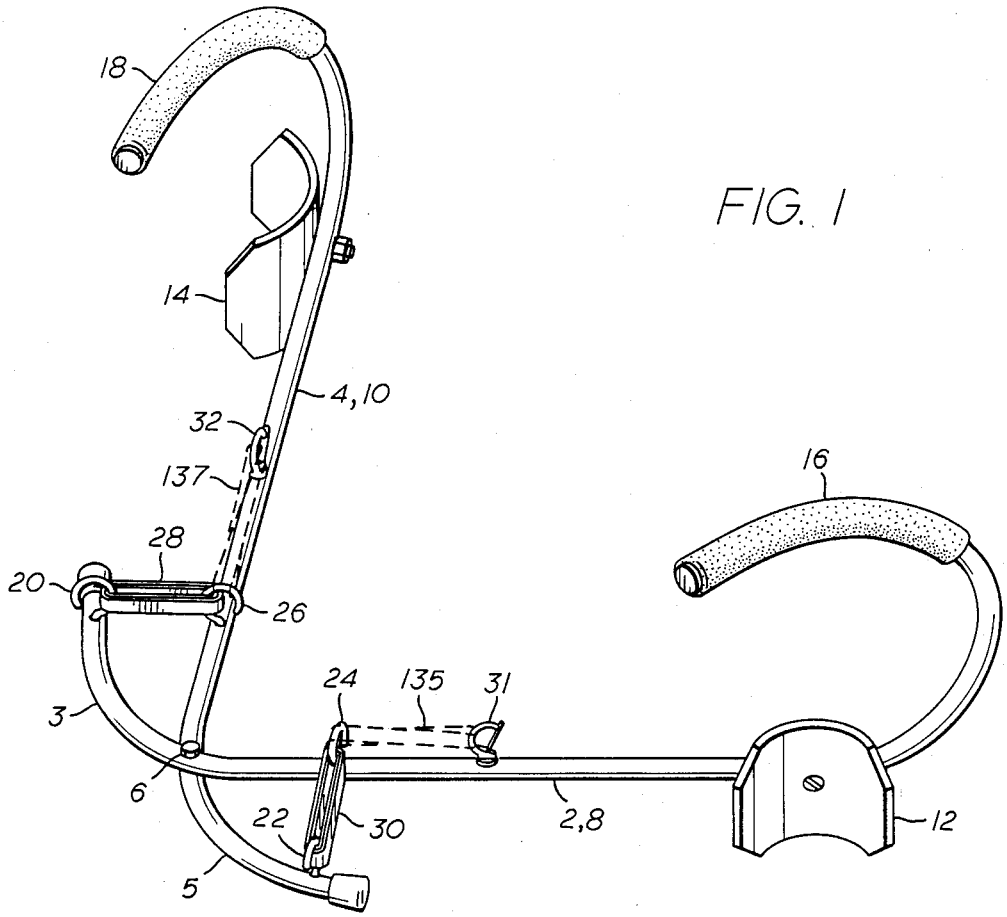
FIG. 1 is a perspective view of a preferred embodiment of the exerciser in open position, the position or attitude of the device at the time the user picks it up to start her period of exercise.
Figure 2:
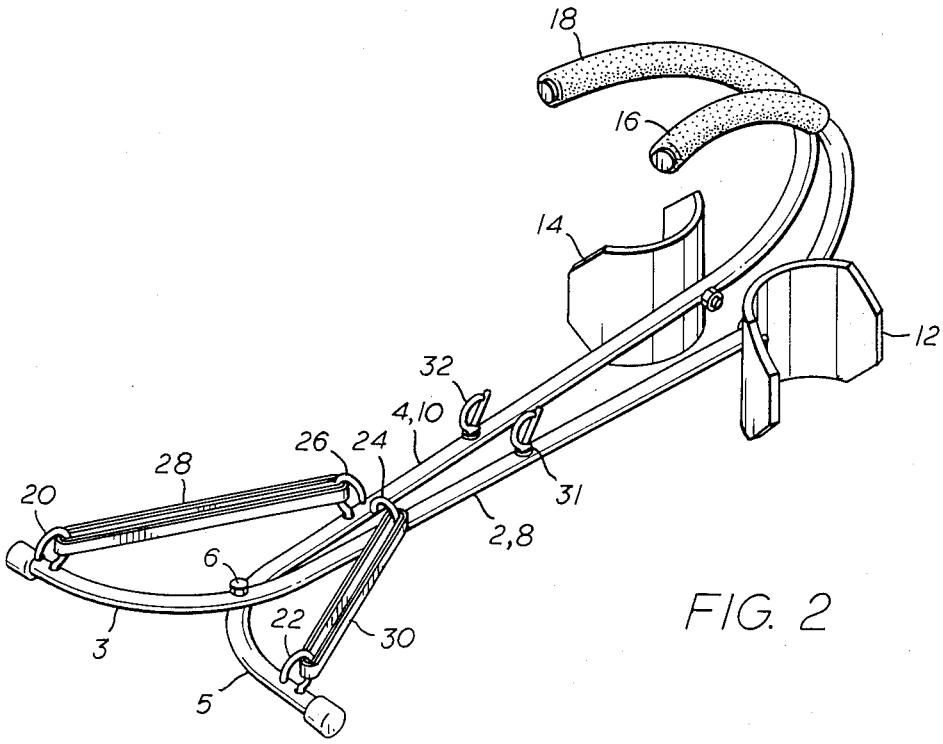
FIG. 2 is a similar perspective view showing the exerciser in closed position, after the user has pushed the two proximal ends of the device together.
Figure 3:
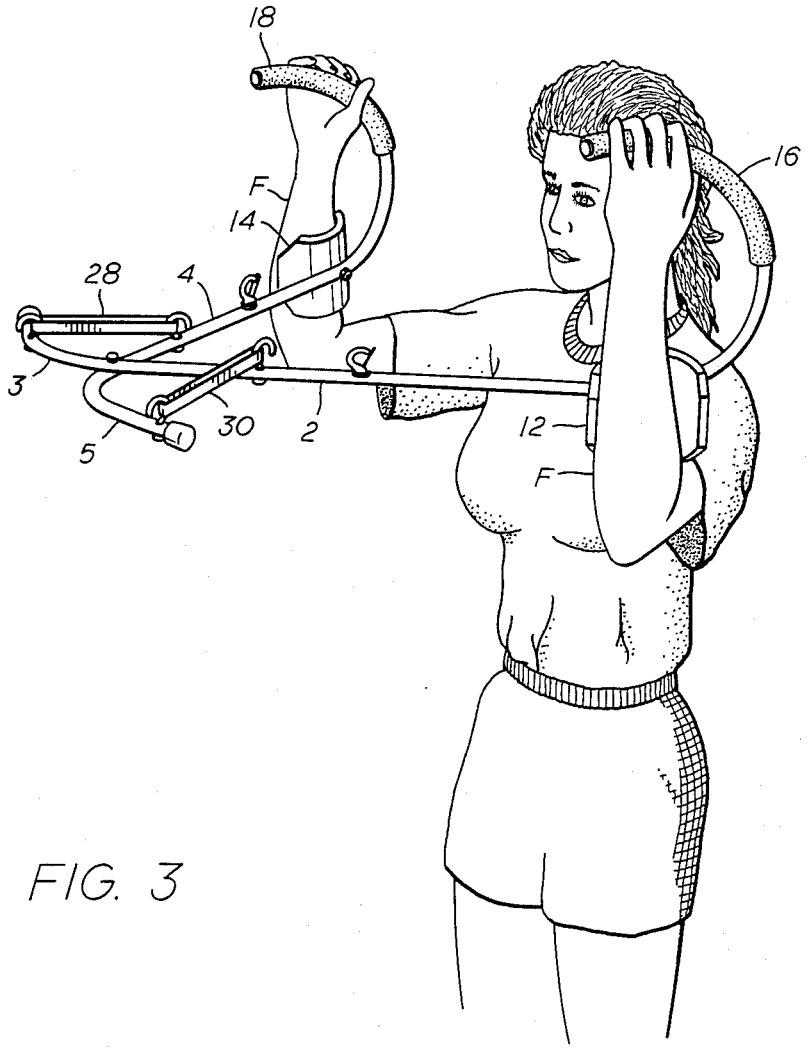

And FIG. 3 is an illustration of a woman holding the exerciser in the normal position for chest exercises, the device being held with both levers lying in a horizontal plane at about upper chest elevation.

In the drawing the exerciser is shown to consist principally of the lefthand lever 2 and righthand lever 4, rotatably connected to one another near one pair of ends by the pivot pin 6, levers 2 and 4 in the illustrated embodiment being of aluminum tubing. The location of pivot pin 6 is utilized, for purposes of description, to define parts and portions of the device, each small portion of a lever 2 or 4 being called its "distal portion" 3 or 5 and each larger portion its "proximal portion" 8 or 10. It should be noted that, with the exception of the proximal end handle of each lever (yet to be described), each lever lies entirely in one plane and the two levers are coplanar, as is also true of any scissors-like device. Lefthand lever 2 has its distal portion 3 bent back to the right while distal portion 5 of the righthand lever 4 is bent backwardly and to the left, for reasons to be described below.

Each lever 2 or 4 has a proximal portion 8 or 10 which extends in a straight line from pivot pin 6 up to a point near the proximal end, whereat is mounted a forearm cup 12 or 14. These cups are contoured to receive the average size forearm at about midlength, and are rigidly secured to the levers. It should be noted that they are mounted on the levers with their concave surfaces facing outwardly, so that the user grips the exerciser between her two forearms. This puts the device in a position wherein the user's movement of her two forearms together will force the proximal ends of the levers together, stretching the resilient means and acting against their restorative force. No exertion is needed on the part of the user for the return stroke, as the resilient means biases the device to the open position; the user need only relax and the device will return to the open position of it own accord.

Handles 16 and 18 are provided by bending the ends of the proximal portions 8 and 10 of the two levers to curve upwardly and forwardly, so that they point toward the pivot 6. Handles 16 and 18 are also offset slightly toward the vertical midplane of the exerciser, to conform to the natural position of the user's hands as she holds the device between her forearms. In normal use her forearms will be vertical and parallel to each other, with the palms facing one another from opposite sides of her chest. As stated above, the handles are not essential in actual use of the device as an exerciser, but are a convenient means for getting the exerciser into the proper position.

Jumping to the distal portion 3 and 5 of the exerciser, the reader will note from the drawing that each distal portion is curved, lefthand portion 3 curving backwardly and to the right while righthand portion 5 curves backwardly and to the left. The reason for providing such curvatures lies in the fact that a point near the tip of each lever constitutes the point of anchorage 20 or 22 for one end of the resilient means 28 or 30. Each such resilient means has its other end secured to the proximal portion of the other lever of the exerciser at a point 24 or 26 whose distance from pivot pin 6 is about equal to the distance from the pivot pin of the distal end anchorage. It can be appreciated that, as the exercise is activated from the open position shown to the closed position whereat the proximal ends come together, the anchorage points 20 and 22 rotates toward the midplane of the exerciser along circular arcs centered on pivot pin 6, and similarly for the other pair of anchorage points 24 and 26. The distance between anchorage points for each of the resilient means 28 and 30 increases, which can only happen if the resilient means increases in length, and this is the whole object of the device, to provide a mechanical force which must be overcome by the muscles of the user. However, as the user goes through what might be called her "exertion stroke", the exertion required of her from one instant to the next will vary directly with the length of the resilient means. For the benefit of the user's musculature it is highly desirable that the force required of her during the exertion stroke should increase more than linearly, and for this reason the curvature of distal portions 3 and 5 and the location of anchorage points 20 and 22 are significant. Distal portions 3 and 5 may alternatively be straight-line portions, continuations of proximal portions 8 and 10, but this construction will not afford the same challenge to the user. The reader may satisfy herself of the accuracy of these observations by a little trigonometry and by determining the length of the resilient means at various given times by application of the law of cosines (any side squared equals the sum of the squares of the other two sides minus twice their product times the cosine of the included angle), the other two sides of the formula being the distances of the two anchorage points from the pivot pin, both of which are fixed, and the included angle being that between the intersecting line segments running from the pivot pin to the two anchorage points.

In the illustrated embodiment both pairs of anchorage points 20,22 and 24,26 are simple eyebolts threadedly secured to the pair of levers; the eyes may be left partially open for ease of mounting and removing resilient means, taking care to orient the open portion to avoid unplanned removal. Any convenient anchorage means may be substituted which does not bind the resilient means or otherwise interfere with its proper functioning. The resilient means 28 or 30 in each case consisted of a number of elastic bands; in an embodiment actually built and tested extensively there were 6 such bands (3 in each location), described as Plymouth Co's rubber bands measuring six inches in girth length by 5/8th inch wide. This proved adequate for use by the average user, a force of ten pounds being required to completely close the exerciser, but the present inventor recognizes that more or less bands will be required for different users, and even for the same user as her muscle development progresses. For this reason a supply of spare elastic bands 135 or 137 is provided on each lever, bands identical to those of resilient means 28 and 30. These are conveniently disposed between auxiliary hooks 31 or 32 and anchorage eyescrews 24 or 26, where they may be readily detached from only the auxiliary hook and inserted in anchorage eyescrews 20 or 22.

FIG. 3 illustrates a woman actually using the described preferred embodiment of the invention as a chest muscle exerciser. It will be noted that her forearms F are vertical and parallel to each other, and are received in the forearm cups 12 and 14 on the outside of the exerciser. She is prepared to move her forearms toward each other, always maintaining their vertical orientation, much like the closing jaws of a vise. It should also be noted that she is holding the exerciser in a horizontal plane at at her upper chest level, the position recommended for maximum flexing of the pectoral muscles. She will now press inwardly with her forearms until complete closure of the device, handles 16 and 18 touching, will then relax and let the resilient means pull the levers back to the illustrated open position, then start the next cycle of exertion stroke followed by relaxation stroke, etc. As in all such devices, a greater challenge and benefit will be obtained if the user avoids "bounce" or "rebound", i.e., taking advantage of recoil. This avoidance can be accomplished, for instance, by momentary pauses at the end of each stroke, and even in the middle of each exertion stroke.

To complete the description of the preferred embodiment actually built and tested, the total weight was two pounds, and the overall dimensions in the open position of the exerciser were about 17 inches long by 36 inches wide by 11 inches high; in closed position the width is only about 12 inches while the length is 24 inches, which makes it a simple matter to transport the device. The tubing is all ⅝ths or ¾ths-inch aluminum, and the forearm cups were of PVC pipe measuring 3 inches in diameter by 3 inches high. When using the 6 elastic bands described above, the user was required to exert a force of 10 pounds to close the exerciser.

In all of the above, the exerciser of the invention has been described only as a chest muscle exerciser, and used as such only with the user in standing position. It can also be used to benefit the user as a chest exerciser when she is is sitting, and may be used in either standing or sitting position to exercise various other muscles, e.g., between the thighs or between the calves. It is to be understand that such uses are included within the scope of the invention even though the term "chest exercise" may be used in some of the claims below.

Now that a preferred embodiment has been described, it will be apparent to those of average skill in the art that there are many variations of the invention which do not depart form its central concept, that of a forearm exerciser consisting of a pair of levers pivoted together near one pair of their ends to separate them into short distal portions and longer proximal or handle portions, the two levers acting in one plane in the manner of a pair of scissors or shears against the force of resilient means having its ends secured to the distal portion of one lever and the proximal portion of the other, and biasing the exerciser to the open position. An important feature of the invention is that it is activated by the forearms, accomplished structurally by providing a pair of contoured forearm receivers near the ends of the proximal portions of the levers, such forearm receivers being disposed on the outer sides of the pair of levers, so that the user grips the exerciser between her forearms preparatory to an exertion stroke in which she moves her vertical forearms toward one another and flexes her chest muscles in overcoming the restraining force of the resilient means. The scope of the invention should not be limited by the foregoing description, but only by the following claims, which should be construed to embrace all substantially equivalent means operating in substantially the same manner to obtain substantiallly the same results.

What is claimed is:

1. An exerciser comprising a pair of levers secured together by a pivot pin near one set of ends to operate in the manner of a pair of scissors, such pivot pin separating each lever into a short distal portion and a longer proximal or handle portion, resilient means biasing the exerciser in an open position and having one of its ends connected to the distal portion of one lever and its other end to the proximal portion of the other lever, and a pair of concave forearm cups secured to the proximal portions of the levers adjacent their free ends, each such forearm cup being secured to the outside of its lever with its concavity facing away from the center plane of the device, whereby the user may insert her forearms into the cups and use the device by pushing the proximal ends of the levers toward one another to the closed position of the exerciser against the restraining force of the resilient means, in which said distal portions of the levers are curved relative to a plane passing through the pivot pin and bisecting the angle betweem the levers, the curvature at each distal portion being away from such bisecting plane, the proximal portions of the levers between the pivot pin and said forearm cups being lineal, and in which said proximal portions of the levers include a curved handrest subportion disposed between said forearm cups and the tips of the levers, said subportion of each lever being bent to extend above the lineal portion and offset inwardly toward said bisecting plane, whereby when the user grips the exerciser between her forearms her hands fall naturally into the handrests.

2. A chest exerciser having a use position in a horizontal plane and comprising a pair of levers having major straightline portions lying in such horizontal plane, such pair of levers being rotatably secured together near to one pair of their ends by a vertical pivot pin passing through both levers, said levers and exerciser having an open position in which the angle between the levers is an obtuse angle, in which position said levers are symmetric in a vertical plane passing through the pivot pin and bisecting such obtuse angle, said pivot pin dividing each lever into a short distal portion and a long proximal portion, the two distal portions being equal to each other in length and likewise for the proximal portions, resilient means disposed between the distal portions and the proximal portions with one end of the resilient means secured to an anchorage on the distal portion of one lever and the other end secured to an anchorage on the proximal portion of the other lever, and a pair of concave forearm cups secured to the proximal portions of the levers adjacent the free ends thereof, said forearm cups being generally vertical and secured to the outsides of the pair of levers so that their concavities face away from the vertical plane of symmetry, in which said distal portions of the levers are curved relative to the plane passing through the pivot pin and bisecting the angle betweem the levers, the curvature at each distal portion being away from such bisecting plane, the proximal portions of the levers between the pivot pin and said forearm cups being lineal, and in which said proximal portions of the levers include a curved handrest subportion disposed between said forearm cups and the tips of the levers, said subportion of each lever being bent to extend above the lineal portion and offset inwardly toward said bisecting plane, whereby when the user grips the exerciser between her forearms her hands fall naturally into the handrests.

3. A chest exerciser having a use position in a horizontal plane and comprising a pair of levers having major straightline portions lying in such horizontal plane, such pair of levers being rotatably secured together near to one pair of their ends by a vertical pivot pin passing through both levers, said levers and exerciser having an open position in which the angle between the levers is an obtuse angle, in which position said levers are symmetric in a vertical plane passing through the pivot pin and bisecting such obtuse angle, said pivot in dividing each lever into a short distal portion and a long proximal portion, the two distal portions being equal to each other in length and likewise for the proximal portions, resilient means disposed between the distal portions and the proximal portions with one end of the resilient means secured to an anchorage on the distal portion of one lever and the other end secured to an anchorage on the proximal portion of the other lever, and a pair of concave forearm cups secured to the proximal portions of the levers adjacent the free ends thereof, said forearm cups being generally vertical and secured to the outsides of the pair of levers so that their concavities face away from the vertical plane of symmetry, in which said levers are a lefthand lever and a righthand lever, and said resiliet means are disposed in part between the distal portions of the lefthand lever and the proximal portion of the righthand lever, and in part between the distal portion of the righthand lever and the proximal portion of the lefthand lever, in which said resilient means are a number of elastic bands and further includes an auxiliary hook for elastic bands on the proximal portion of each :ever, said auxiliary hook being disposed between the anchorage point on said proximal portion and the forearm cup thereon, and which includes a number of spare elastic bands secured on the exerciser between one of said auxiliary hooks and the anchorage point disposed on the same proximal portion of the lever.

4. A chest exerciser consisting basically of a pair of levers rotatably connected together by a pivot pin dividing such levers, in the manner of a pair of pruning shears, into short distal portions and longer proximal portions, each proximal portion having a straight line part up to a point near its free end and having a forearm cup mounted thereon at such point, the exerciser having an open position in which there is a large angle between such proximal portions of the levers and a closed position in which such angle is reduced to about zero and such proximal portions are touching, and resilient means disposed between one anchorage point near the free end of a distal point of one lever and a second anchorage point on the proximal portion of the other lever, such resilient means biassing the exerciser in the open position, each said forearm cup being concave and being mounted on the outside of the lever with its concavity facing outwardly, in which said distal portions of the levers are curved relative to the plane of symmetry passing through the pivot pin and bisecting the angle betweem the levers, the curvature at each distal portion being away from such bisecting plane, the proximal portions of the levers between the pivot pin and said forearm cups being lineal, and in which said proximal portions of the levers include a curved handrest subportion disposed between said forearm cups and the tips of the levers, said subportion of each lever being bent to extend above the lineal portion and offset inwardly toward said bisecting plane, whereby when the user grips the exerciser between her forearms her hands fall naturally into the handrests.

* * * * *